United States Patent [19]

Mochizuki et al.

[11] Patent Number: 4,474,026

[45] Date of Patent: Oct. 2, 1984

[54] REFRIGERATING APPARATUS

[75] Inventors: Taketoshi Mochizuki; Mitsuo Kudo, both of Shimizu; Akira Arai, Sakuramurayoko; Keiji Shono, Toyonaka; Masaichi Omori, Hachioji; Genichiro Nishi, Sagamihara, all of Japan

[73] Assignee: Hitachi Ltd., Tokyo, Japan

[21] Appl. No.: 341,328

[22] Filed: Jan. 21, 1982

[30] Foreign Application Priority Data

Jan. 30, 1981 [JP] Japan ..... 56-11705
Jan. 30, 1981 [JP] Japan ..... 56-11706

[51] Int. Cl.[3] ..... G05D 23/19; F25B 5/00; F25D 21/06

[52] U.S. Cl. ..... 62/157; 62/199; 62/231; 62/278; 62/283; 62/510

[58] Field of Search ..... 62/283, 199, 200, 510, 62/196.1, 196.2, 196.3, 227, 229, 157, 231, 234, 155, 278, 196 A, 196 R, 196 C

[56] References Cited

U.S. PATENT DOCUMENTS

| | | | |
|---|---|---|---|
| 2,479,732 | 8/1949 | Dobson | 62/200 X |
| 2,923,135 | 2/1960 | Preotle | 62/283 X |
| 3,209,553 | 10/1965 | Sohda | 62/283 |
| 3,633,377 | 1/1972 | Quick | 62/510 X |

*Primary Examiner*—Harry B. Tanner
*Attorney, Agent, or Firm*—Darby & Darby

[57] ABSTRACT

A refrigerating apparatus comprises two refrigerant circuits connected in a parallel fashion which include a common condenser. An evaporating temperature in an evaporator of one refrigerant circuit is set to a relatively high temperature compared with that of an evaporator of the other refrigerant circuit, so that a two-temperature evaporation type refrigerating apparatus is formed and a compressor of one refrigerant circuit can be intermittently driven for each predetermined time period in a forced manner. In a defrosting mode, the condenser is made to operate as an evaporator, whereby the evaporator included in the other refrigerant circuit is defrosted.

16 Claims, 7 Drawing Figures

REFRIGERATING APPARATUS

BACKGROUND OF THE INVENTION

1. Field of the Invention

The present invention generally relates to a refrigerating apparatus. More particularly, the present invention relates to a refrigerating apparatus which adopts a two-temperature evaporation system.

2. Description of the Prior Art

FIG. 1 is a schematic diagram showing an example of an open display cabinet using a refrigerating apparatus constituting the background of the invention. The display cabinet 1 includes a body 3 having an inner case 5 which is provided with a plurality of shelves 7. The body 3 is comprised of heat insulating material. A cooling air passage 9 is defined between an inner wall surface of the body 3 and the inner case 5. The body 3 and the inner case 5 comprise an opening in a front surface thereof. A cooling air issuing slit 11 is defined between the body 3 and the inner case 5 at an upper end of the front opening and a cooling air drawing slit 13 is defined between the body 3 and the inner case 5 at a lower end of the front opening. As a result, an air curtain 15 is provided between the cooling air issuing slit 11 and the cooling air drawing slit 13 and thus commodities stocked on the shelves can be prevented from being exposed to the atmosphere. A fan 17 is located in a bottom portion of the cooling air passage 9. A main or first cooler C1 is located in a lower vertical portion of the cooling air passage 9. A sub or second cooler C2 is also located in a bottom portion of the cooling air passage 9 and in an upstream portion relative to the first cooler C1. By way of an example, the surface temperature of the second cooler C2 is set to the vicinity of 0° C. (but over 0° C.) and the surface temperature of the first cooler C1 is nearly set to −10° C. through −15° C.

High temperature and moisture laden air drawn by the fan 17 through the air drawing slit 13 is cooled and the moisture contained therein is removed in the form of water by the second cooler C2. The resultant air containing less moisture is further cooled to a predetermined temperature, for example, approximately −5° C., by the first cooler C1 provided in the downstream. The air cooled by the first cooler C1 is issued through the cooling air issuing slit 11 to cool the inside of the cabinet 1 to a predetermined temperature, for example about 0° C. through 2° C. The cooling air thus issued is again drawn from the air drawing slit 13 together with ambient air. In such a manner, the cooling air is circulated. The cooling air issued through the cooling air issuing slit 11 forms the air curtain 15 which prevents an ambient air from entering the inside of the cabinet 1.

In accordance with the open display cabinet 1 adopting a conventional two-temperature evaporation system as shown in FIG. 1, the number of times of defrosting the first cooler C1 can be reduced, because the air is fed to the first cooler C1 after removing the moisture contained in the air by means of the moisture removing action of the second cooler C2, and thus the accumulated amount of frost on the first cooler C1 is reduced. Accordingly, it brings about a beneficial effect that damage to the stocked commodities due to rise of the temperature in the inside of the cabinet 1 caused by such defrosting is diminished.

FIG. 2 and FIG. 3 are circuit diagrams showing an example of a refrigeration cycle adopting a two-temperature evaporation system which can be used in the open display cabinet shown in FIG. 1, respectively. Referring to FIG. 2, a refrigeration cycle is adapted such that a compressor 21, a condenser 22, a first expansion valve or pressure reducing means 23, a first cooler or evaporator 24, a second expansion valve or pressure reducing means 25 and a second cooler or evaporator 26 are connected in series. In the example of FIG. 2, the first evaporator 24 corresponds to the second cooler C2 of FIG. 1 and the second evaporator 26 corresponds to the first cooler C1.

In the example of FIG. 3, a dual refrigeration cycle is used wherein the respective refrigeration cycles are adapted such that a first compressor 31 (a second compressor 31'), a first condenser 32 (a second condenser 32'), first pressure reducing means 33 (second pressure reducing means 33') and a first evaporator 34 (a second evaporator 34') are connected in series. The first evaporator 34 of FIG. 3 corresponds to the first cooler C1 of FIG. 1 and the second evaporator 34' corresponds to the second cooler C2.

In the open display cabinet shown in FIG. 1, an evaporating pressure regulating valve (not shown) is usually used for the refrigeration cycle such as those shown in FIGS. 2 and 3, so as to always maintain the surface temperature of the second cooler C2 over 0° C. The use of such an evaporating pressure regulating valve permits an evaporating pressure in a cooler or an evaporator to be always maintained constant. For that reason, when the temperature in the inside of the cabinet 1 is relatively low or the ambient temperature is relatively low and the temperature of the air drawn from the drawing slit 13 falls to near 0° C., the difference between the surface temperature of the second cooler C2 and the temperature of the drawn air becomes very small and thus quantity of heat to be exchanged is reduced. As a result, the moisture removing action of the second cooler C2 is drastically reduced, which brought about a disadvantage that the amount of frost accumulated onto the first cooler C1 is increased.

Furthermore, in case that a mechanism is not provided for regulation of evaporating pressure in an evaporator such as an evaporating pressure regulating valve, a disadvantage has been brought about that efficiency of driving is lowered when the temperature in the inside of the cabinet or the ambient temperature is relatively low and the drawn air is relatively low. More particularly, when in case that the temperature of the air drawn through the drawing slit 13 is relatively high, the moisture contained in such high temperature air is condensed in the second cooler C2 and removed in the form of water since the surface temperature of the second cooler C2 is set to approximately 0° C. However, since an evaporating temperature in the second cooler C2 falls when the temperature of the drawn air is relatively low, the surface temperature of the second cooler C2 goes below 0° C. Consequently, a portion of moisture contained in the drawn air is frozen or frosted on a surface of the second cooler C2, which leads to blocking of the second cooler C2 and thus lowers the evaporating pressure therein, with the consequence of diminishing the efficiency of operation.

In addition, when the dual refrigeration cycle as shown in FIG. 3 is used, since the coefficient of performance in one refrigeration cycle including the second cooler C2 (34'), the evaporating temperature of which is higher than that of the other refrigeration cycle, the efficiency of driving is relatively high as a whole refrigerating system. However, even in such a case, if and when a refrigeration load is decreased, it is difficult to set the surface temperature of the second cooler C2 to an approximate 0° C. As a result, the second cooler C2 is covered with frost in a manner similar to the example of FIG. 1, and consequently the evaporating temperature of the cooler C2 lowers. Accordingly, it is difficult to maintain efficient driving for a long time, and also maintain the range of the refrigeration load capable of efficiently operating a refrigeration cycle including an evaporator having a relatively high evaporating temperature.

Conventionally, in the open display cabinet such as shown in FIG. 1, frost is still accumulated onto the first cooler C1 even if moisture contained in the air is removed using the second cooler C2. Accordingly, the frost accumulated onto the first cooler C1 is necessary to be removed. According to a conventional defrosting system in a refrigerating apparatus, it is known to remove the frost accumulated onto a front surface of the first cooler C1 by energizing a heater which is provided in a front surface of the cooler or evaporator. Since the conventional defrosting system is of a system wherein air is heated and the frost is melted by means of action of heat conduction through convection of the heated air, not only does it take a long time to defrost, but also it takes much heat loss and thus expends much electric power. In addition, the above described heat loss heats a cooling air flowing through a cooling air passage more than necessary, which results in a rise in temperature of commodities stocked in the inside of the cabinet. Consequently, a problem arises that the quality of the commodities is deteriorated.

SUMMARY OF THE INVENTION

The refrigerating apparatus in accordance with the present invention is structured as a refrigeration cycle adopting a two-temperature evaporation system in which a common condenser is utilized. The refrigerating apparatus includes a closed refrigerant circuit in which first compressor means, condenser means, first pressure reducing means, first evaporator means are connected together, in this order, through lines, and a bypass refrigerant circuit connected in parallel with the closed refrigerant circuit, both circuits having common condenser means, the bypass refrigerant circuit being adapted such that second pressure reducing means, second evaporator means and second compressor means are connected together, in this order, through lines. In a refrigeration mode, the evaporating temperature of refrigerant in the second evaporator means is set higher than that in the first evaporator means and the second compressor means is intermittently driven in accordance with predetermined controlling factors. Thus, by intermittently driving the second compressor means in a forced manner, defrosting is efficiently effected by the second evaporator means, with the result of diminishing frost accumulated onto the first evaporator means, even if an ambient temperature or the temperature in the inside of the cabinet is relatively low and the temperature of the air drawn into a cooling passage lowers to the vicinity of 0° C. Further, by using such intermittent operation, the ratio of heat exchange by the second evaporator means having a high evaporating temperature to all the quantity of heat exchange can be enhanced and thus a refrigerating apparatus adopting a two-temperature evaporation system having a good efficiency of operation can be obtained.

In a preferred embodiment of the present invention, a refrigerating apparatus can operate both in a refrigeration operating mode and a defrosting operating mode. In the defrosting mode, a discharging side of the first compressor means and/or the second compressor means is connected to an outlet of the first evaporator means and the condenser means is made to operate as an evaporator, whereby a hot gas from the condenser means causes the first evaporator means to be defrosted. In accordance with the preferred embodiment, the necessity of use of a conventional electric heater is eliminated and thus the air flowing through a cooling air passage can not be heated more than needed. Consequently, the temperature in the inside of the cabinet can not be abnormally raised to damage commodities stocked therein and in addition, both the defrosting of the first evaporator means is made for a relatively short time and consumed power can be minimized.

In another embodiment of the present invention, in the refrigerating mode, the second compressor means is intermittently driven in a forced manner and the first compressor means is also intermittently driven in accordance with a refrigeration load of the refrigerating apparatus. In accordance with this embodiment, since the amount of refrigerant which passes through the condenser means while the first compressor means is stopped is decreased, a condensing pressure in the condenser means lowers and the coefficient of performance of the second compressor means is enhanced and thus operation efficiency in the whole refrigerating apparatus can be further enhanced.

In order to intermittently drive the second compressor means, control factors, such as time or temperature associated with the second evaporator means are detected. Further, in order to select refrigerant passages either in a refrigerating mode or defrosting mode, a four way selection valve, for example, may be used.

Accordingly, a principal object of the present invention is to provide a refrigerating apparatus using a two-temperature evaporation system wherein high operation efficiency can be obtained even in an arbitrary operating condition.

Another object of the present invention is to provide a refrigerating apparatus using a two-temperature evaporation system wherein frosting in a cooler or an evaporator can be minimized.

A further object of the present invention is to provide a refrigerating apparatus using a two-temperature evaporation system wherein the frost accumulated onto a main evaporator can be efficiently defrosted.

An aspect of the present invention resides in a refrigerating apparatus having a common condenser using a two-temperature evaporation system wherein compressor means associated with evaporator means having high evaporating temperature is made to be intermittently driven in a forced manner.

Another aspect of the present invention resides in a refrigerating apparatus using a two-temperature evaporation system wherein a compressor associated with the evaporator means having a low evaporating temperature is intermittently driven according to the refrigeration load.

A further aspect of the present invention resides in a refrigerating apparatus using a two-temperature evaporation system wherein in a defrosting mode, the discharging side of the compressor is connected to an outlet of a main or first evaporator thereby to make a common condenser means operate as an evaporator so as to defrost the evaporator means having a low evaporating temperature.

These objects and other objects, features, aspects and advantages of the present invention will become more apparent from the following detailed description of the present invention when taken is conjunction with the accompanying drawings.

DESCRIPTION OF THE PREFERRED EMBODIMENTS

Figure 4:
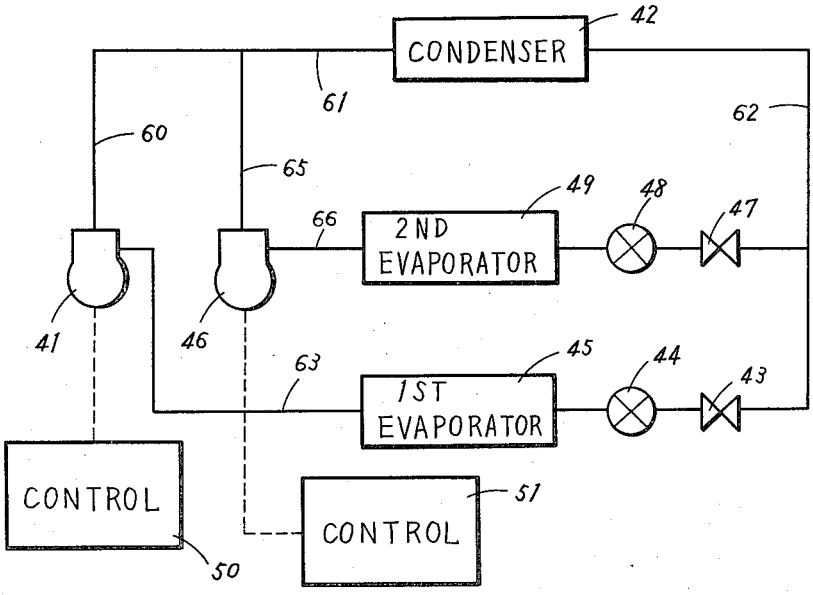
FIG. 4 is a circuit showing a refrigeration cycle in accordance with an embodiment of the present invention.

FIG. 4 is a circuit showing a refrigeration cycle in accordance with an embodiment of the present invention. In this embodiment, a first compressor 41, a condenser 42, a first electromagnetic valve 43, a first expansion valve or pressure reducing means 44 and a first evaporator 45 are connected in series through lines 60, 61, 62 and 63, which constitutes a main refrigerant circuit or a closed refrigerant circuit. The line 62 connected an outlet of the condenser 42 is bypassed to constitute a subrefrigerant circuit or bypassing refrigerant circuit including a second electromagnetic valve 47, a second expansion value or pressure reducing means 48, a second evaporator 49 and a second compressor 46. The lines 60 and 65 in the discharging side of the first and second compressors 41 and 46 are, respectively, connected to the line 61 coupled to an inlet of the condenser 42. A suction side of the first and second compressors 41 and 46 are connected to the outlets of the first and second evaporators 45 and 49 through the lines 63 and 66. In this refrigeration cycle, the evaporating temperature of the refrigerant in the second evaporator 49 is set higher than that in the first evaporator 45. The first evaporator 45 corresponds to the main cooler C1 shown in FIG. 1 and the second evaporator 49 corresponds to the cooler C2 for removing moisture. The driving of the first compressor 41 is controlled by a control circuit 50 and the operation of the second compressor 46 is controlled by a control circuit 51. The control circuit 50 controls the first compressor 41 so as to make the first compressor 41 intermittently operate according to the refrigeration load of the refrigerating apparatus. To this end, the control circuit 50 includes a temperature setting means (not shown) for setting the temperature according to the refrigeration load, for example. The control circuit 51 controls the second compressor 46 so as to make the second compressor 46 intermittently operate in a forced manner. As an example, the control circuit 51 includes a timer (not shown). The timer (not shown) can measure, a predetermined time period, for example, thirty minutes and subsequently measure another predetermined time period, for example, three minutes. The control circuit 51 controls the second compressor 46 according to an output of the timer, so that the second compressor 46 repeats an intermittent operation such that the second compressor 46 operates for a predetermined time period, for example, thirty minutes and the operation thereof is stopped for three minutes subsequent to the above described thirty minutes.

Prior to explaining a specific operation of the FIG. 4 embodiment, a general operation thereof will be explained. A high temperature and high pressure, gaseous refrigerant from the first and second compressors 41 and 46 is led to the condenser 42 through the lines 60 and 65 and the line 61. In the condenser 42, the gaseous refrigerant is changed into a liquid refrigerant which flows into the first and second expansion value 44 and 48 through the line 62 and the first and second electromagnetic valves 43 and 47. The first and second pressure reducing means 44 and 48 reduce, respectively, the pressure of the liquid refrigerant thus led, the pressure reduced refrigerant flowing into the first and second evaporators 45 and 49 of the next stage. The first and second evaporators 45 and 49 evaporate the liquid refrigerant to reproduce a gaseous refrigerant which is fed to the respective suction sides of the first and second compressors 41 and 46, respectively, through the lines 63 and 66. Thus, the refrigeration cycle is formed and a cooling operation is achieved by the first and second evaporators 45 and 49.

Next, assuming that the refrigeration cycle shown in FIG. 4 is applied to the open display cabinet shown in FIG. 1, the specific operation thereof will be described. A high temperature and much moisture containing air drawn from the air drawing slit 13 by the fan 17, is moisture removed in the form of water or frost, by the second evaporator 49 (the second cooler C2) wherein the evaporating temperature is set to the vicinity of 0° C. including below 0° C. As a result, the amount of frost accumulated onto the first evaporator 45 (the main cooler C1) is decreased. Accordingly, the number of times of defrosting can be lessened and consequently, the variation of the temperature in the inside of the cabinet caused by the defrosting can be minimized.

In addition, even if an ambient temperature or the temperature in the inside of the cabinet is relatively low and the temperature of the air drawn lowers to the vicinity of 0° C., the amount of the frost accumulated onto the second evaporator 49 can be minimized, as described subsequently. More particularly, the second compressor 46 is controlled by the control circuit 51 so as to be intermittently driven as described in the foregoing. When the operation or driving of the second compressor 46 is stopped, cooling operation made by the associated second evaporator 49 is stopped. Accordingly, since refrigerating capability is insufficient through a mere use of the first evaporator 45, the temperature of the air drawn rises to over 0° C., so that the increase in the amount of frost accumulated onto the second evaporator 49 can be prevented. Hence, even in case that the temperature of the air being drawn is low, an efficient moisture removal is made by the second evaporator 49 for a longer time period and the decrease in the evaporating pressure caused by frosting in the second evaporator 49 can be effectively prevented and as a result the decrease in an operation efficiency of the second compressor can be prevented. Furthermore, since the intermittent driving of the second compressor 46 as described in the foregoing causes the temperature range of efficiently operating the second evaporator 49 to be extended to the range wherein the evaporating temperature is low, it is possible to set the large ratio of heat exchange by the second evaporator 49 to all the quantity of heat of exchange. The first compressor 41 associated with the first evaporator 45 in which the evaporating temperature of the refrigerant is low is intermittently driven according to a refrigeration load, while the driving range of the second evaporator 49 in which the evaporating temperature is high and which a coefficient of performance thereof is good can be extended as described in the foregoing and thus the driving ratio of the second compressor 46 can be extended. Therefore, the operation efficiency of the whole refrigerating apparatus can be further enhanced.

The main refrigerant circuit and the bypass refrigerant circuit comprises a common condenser 42. Accordingly, since the amount of refrigerant passing through the condenser 42 is decreased by the discharging amount of the first compressor 41 if and when the first compressor 41 is controlled by the control circuit 50 to stop driving, the condensing pressure in the condenser 42, that is, the pressure in discharging of the second compressor 46 decreases and the coefficient of performance of the second compressor 46 can be further enhanced. As a result, the operation efficiency of the whole refrigerating apparatus can be further enhanced.

In the above described embodiment, the control circuit 51 was explained as comprising a timer for the purpose of intermittent driving of the second compressor 46. However, the control circuit 51 may include a defrosting sensor, a frost sensor or a temperature sensor. A frost sensor (not shown) is of being capable of photoelectrically detecting the frost accumulated onto the second evaporator 49, for example. More particularly, the frost sensor is adapted that the frost is detected according to interruption of light which is caused by the frost accmulated onto the second evaporator 49. If and when the frost accumulated onto the second evaporator 49 is detected by the frost sensor, the control circuit 51 stops the driving of the second compressor 46. A defrosting sensor (not shown) includes a thermometer provided with respect to the second evaporator 49 and withdraws a signal indicating having completion of the defrosting of the second evaporator 49 after a predetermined time period, for example, one minute, after detecting, for example, +2° C. by the thermometer. Correspondingly, the control circuit 51 reinitiates the driving of the second compressor 46.

Meanwhile, it is possible to substitute a temperature sensor for the above described frost sensor. More particularly, the temperature sensor (not shown) is provided in the second evaporator 49 to detect the decrease of the temperature of the refrigerant therein. The control circuit 51 judges the decrease in the refrigerant temperature as accumulating frost onto the second evaporator 49 and stops driving the second compressor 46. At any rate, this control circuit 51 controls the second compressor 46 so as to make the second compressor 46 intermittent operation in a forced manner. Consequently, even in an operating condition that the frost is accumulated onto the evaporator having high evaporating temperature, a refrigerating apparatus can be driven in a extremely high operation efficiency, as described in the foregoing.

Even in case that the surface temperature of the evaporator 49 for removing moisture is always set to over 0° C. so that the frost is not accumulated thereonto, the condenser 42 can be effectively utilized and loss of pressure can be further decreased even if the refrigeration load is small, because the condenser 42 is common to both the evaporators 45 and 49.

Furthermore, even when the surface temperature of the evaporator 49 for removing moisture is below 0° C. and the temperature of the air being drawn is also below 0° C., the same meritorious effect as the described above can be obtained if the driving of the second evaporator 49 is intermittently stopped as described in the foregoing, and the second evaporator 49 is heated by a heater (not shown) and the like in a condition that both sides of the second evaporator 49 or the second cooler C2 (FIG. 1) are interrupted by a damper (not shown), while a cooling air is bypassed to be fed to the first evaporator 45 or the first cooler C1 (FIG. 1) during heating of the second evaporator 49.

Figure 5:
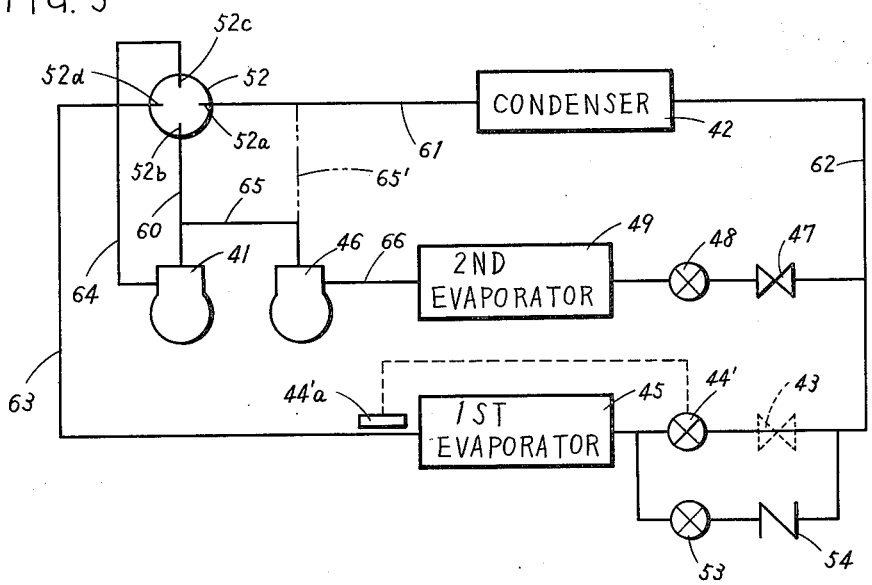
FIGS. 5 to 7 are circuits showing refrigeration cycles in accordance with preferred embodiments of the present invention, respectively.

FIG. 5 shows a circuit of a refrigeration cycle in accordance with another embodiment of the present invention. The present embodiment can be structured in a manner similar to the FIG. 4 embodiment except for the following points. More particularly, a four way selection valve 52 is used, which includes four ports 52*a*, 52*b*, 52*c* and 52*d*. The first port 52*a* of the four way selection valve 52 is connected to the line 61. The second port 52*b* is connected to the line 60 in the discharging side of the first compressor 41, the line 60 being connected to the line 65 in the discharging side of the second compressor 46. The third port 52*c* is connected to the line 64 in a suction side of the first compressor 41 and the fourth port 52*d* is connected to the line 63. A thermo responsive automatic expansion valve 44' is used as an expansion valve or pressure reducing means constituting the first pressure reducing means. For example, type T/TE2 or T/TE5 manufactured by Danfoss Incorporated (Denmark) and the like are commercially available as such a thermo responsive automatic expansion valve 44'. The thermo responsive automatic expansion valve 44' has the directional property that only the flow of the refrigerant from the line 62 into the first evaporator 45 is permitted and the flow of the refrigerant in an opposite direction is blocked. The opening of the forward direction is automatically controlled in response to a sensor 44'*a* for detecting the temperature of a gaseous refrigerant from the first evaporator 45, for example. Accordingly, the opening of the forward direction in the pressure reducing means 44' is automatically controlled in correlation to the load of the first evaporator 45. Instead of use of such a thermo responsive automatic expansion valve 44', a combination of an electromagnetic valve 43 and an expansion valve or pressure reducing means 44 as used in the FIG. 4 embodiment may, of course, be used. A series connection of an expansion valve or pressure reducing means 53 and a check valve 54 is connected to the pressure reducing means 44' in a parallel fashion. In a defrosting mode, the check valve 54 permits the flow of refrigerant from the first evaporator 45 through the pressure reducing means 53 and the line 62 into the condenser 42 and in a refrigeration mode, the check valve 54 blocks the flow of the refrigerant opposite to the flow in the defrosting mode.

Meanwhile, in the FIG. 5 embodiment, the first and second compressors 41 and 46 are controlled by the control circuits 50 and 51 (FIG. 4), respectively. However, illustration of these control circuits is omitted, since the FIG. 5 embodiment relates to an improvement of a defrosting mode rather than a refrigeration mode.

In operation, a refrigeration mode is selected by a mode selecting switch (not shown). If and when the refrigeration mode is selected, the electromagnetic valve 47 is opened. At the same time, the ports 52*a* and 52*b* of the four way selection valve 52 are connected and the ports 52*c* and 52*d* are connected. Accordingly, line 60 in the discharging side of first compressor 41 and thus the line 65 in the discharging side of the second compressor 46 are simultaneously connected through the four way selection valve 52 to the line 61 coupled to an inlet of the condenser 42. The line 64 in the suction side of the first compressor 41 is connected through the four way selection valve 52 to the line 63 coupled to an outlet of the first evaporator 45. A high temperature and high pressure, gaseous refrigerant from the first and second compressors 41 and 46 is led to the condenser 42 through the four way selection valve 52 and the line 61 after the both are delivered in the line 60. The condenser 42 changes the gaseous refrigerant into a liquid refrigerant by cooling the gaseous refrigerant. The liquid refrigerant from the condenser 42 flows into the line 62 and thereafter is bypassed. A portion of the bypassed refrigerant flows into the first evaporator 45 after the pressure thereof is reduced in response to the refrigeration load at that time by the thermo responsive automatic expansion valve 44'. The remainder of the bypassed gaseous refrigerant is led through the electromagnetic valve 47 into the pressure reducing means 48 wherein the pressure is reduced, and flows to the second evaporator 49. In the first evaporator 45, the liquid refrigerant is evaporated and changed into a gaseous refrigerant. Similarly, the second evaporator 49 causes the liquid refrigerant to be changed into a gaseous refrigerant. The evaporating temperature of the refrigerant in the second evaporator 49 is set to a higher temperature than that of the first evaporator 45, which is the same as the previous embodiment. The gaseous refrigerant from the first evaporator 45 is returned to the suction side of the first compressor 41 through the line 63, the four way selection valve 52 and the line 64. The gaseous refrigerant from the second evaporator 49 is returned to the suction side of the second compressor 46 through the line 66. In such a way, a refrigeration cycle is completed and a cooling operation is made by the first and second evaporators 45 and 49.

An operation will be described subsequently where a defrosting mode is selected by a mode selecting switch (not shown). In response to selection of defrosting mode, the electromagnetic valve 47 is closed and the second compressor 46 is stopped. A the same time, an intraconnection of the four way selection valve 52 is operated and the ports 52*b* and 52*d* are connected and thus the lines 60 and 63 are coupled to each other. The ports 52*a* and 52*c* are connected and the lines 61 and 64 are coupled to each other. A hot gas discharged from the first compressor 41 flows into the first evaporator 45 through the line 60, the four way selection valve 52 and the line 63. Therefore, the hot gas heats the first evaporator 45 to melt the frost accumulated onto the surface thereof. In such a way, the refrigerant is changed into the liquid refrigerant in the first evaporator 45 and the liquid refrigerant is introduced to the condenser 42 through the third pressure reducing means 53, the check valve 54 and the line 62. In the condenser 42, the liquid refrigerant is vaporized to be changed into a gaseous refrigerant and the gaseous refrigerant is returned to the suction side of the first compressor 41 through the line 61, the four way selection valve 52 and the line 64. Thus, the defrosting of the first evaporator 45 is made. Completion of the defrosting may be detected using the above described defrosting sensor.

In the above described embodiment, only the first compressor 41 is driven in a defrosting mode. In such a situation, the line 65 in the discharging side of the second compressor 46 may be connected to the line 61 directly coupled to the inlet of the condenser 42, as shown in two-dot chain line 65' in FIG. 5. Alternativey, in the defrosting mode, the first compressor 41 may be stopped and only the second compressor 46 may be driven.

Figure 6:
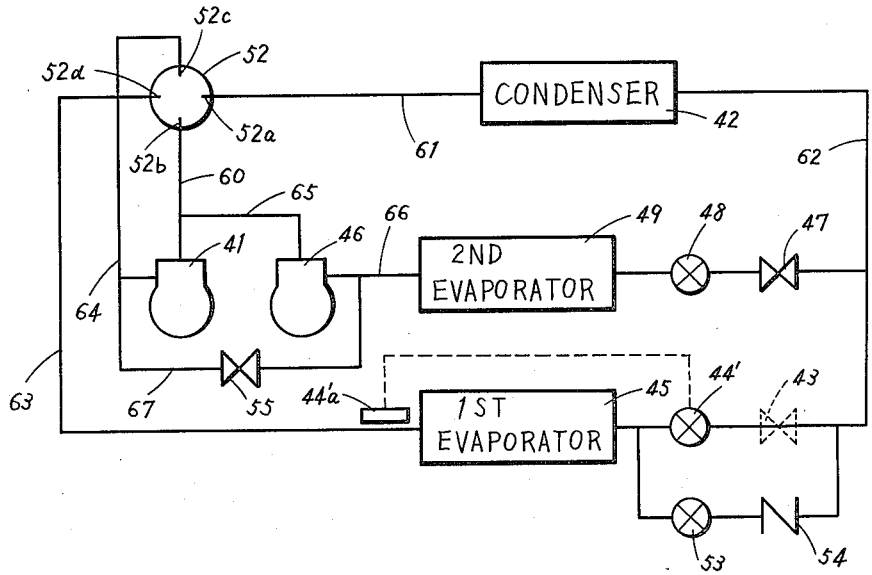

Further, in the above described embodiment, only the first compressor 41 is driven in a defrosting mode. However, even in a defrosting mode, both the first and second compressors 41 and 46 may be driven. In such a case, as shown in FIG. 6, the line 66 coupled to the outlet of the second evaporator 49 is connected to the line 64 is the suction side of the first compressor 41 by way of the line 67 including the electromagnetic valve 55. In the defrosting mode, the electromagnetic valve 55 is opened. Correspondingly, the gaseous refrigerant from the condenser 42 is led to the second compressor 46 through the line 61, the four way selection valve 52 and the lines 64, 67 and 66. Thus, in the defrosting mode, both compressors 41 and 46 can be driven at the same time.

Figure 7:
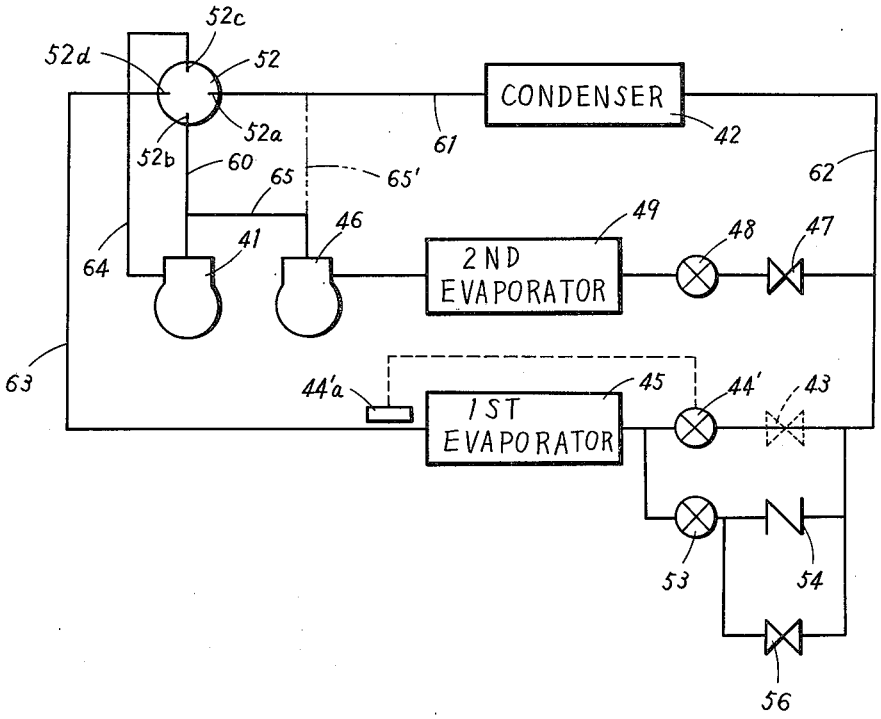

Furthermore, as shown in FIG. 7, a third electromagnetic valve 56 may be connected to the check valve 54 in a parallel fashion. The third electromagnetic valve 56 is advantageously utilized, particularly in when the ambient temperature is relatively low, for example, in winter, or the refrigeration load is relatively small. More particularly, if and when the ambient temperature is low, the flow of the liquid refrigerant from the condenser 42 decreases in a refrigeration mode. Therefore, in order to increase the flow of such liquid refrigerant, the electromagnetic valve 56 is opened to make resistance of the refrigerant passage small in the refrigeration mode.

Figure 1:
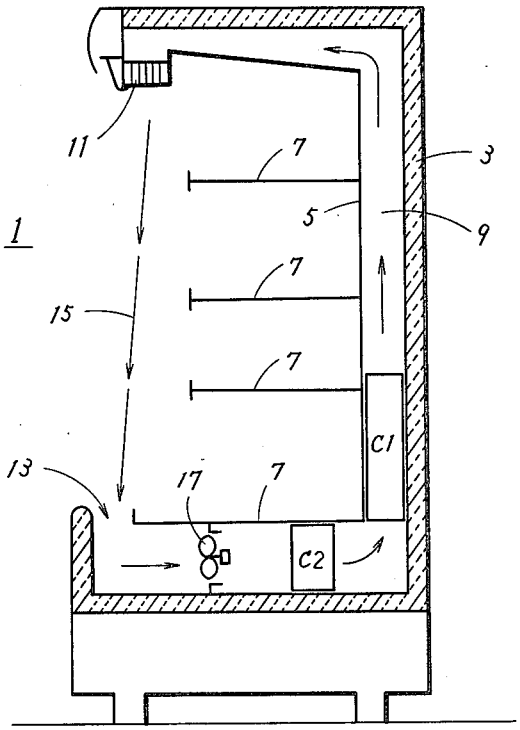
FIG. 1 PRIOR ART
FIG. 1 is a schematic diagram showing an example of an open display cabinet using a refrigerating apparatus constituting the background of the present invention.
Figure 2:
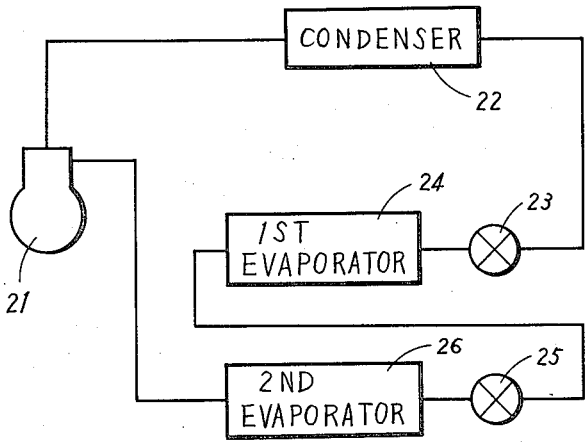
FIG. 2 PRIOR ART
FIGS. 2 and 3 are circuits showing conventional refrigeration cycles which can be used in the open display cabinet shown in FIG. 1, respectively.
Figure 3:
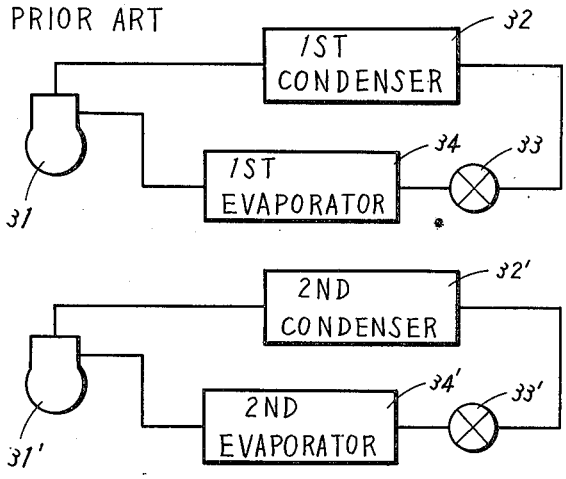

If and when the refrigeration cycle in accordance with the embodiments shown in FIGS. 5 to 7 are applied to the open display cabinet as shown in FIG. 1, the following advantages are obtained. More particularly, in the refrigeration mode, the moisture is removed from the air being sucked by the second evaporator 49 or the second cooler C2 and then the air containing relatively little moisture is cooled by the first evaporator 45 or the second cooler C2. Accordingly, in the refrigeration mode, the amount of the frost accumulated onto the first evaporator 45 can be minimized by a moisture removing action of the second evaporator 49 and thus the efficient operation can be sustained. In addition, in the refrigeration mode, the frost is not accumulated onto the second evaporator 49 and thus it is not necessary to defrost the second evaporator 49. Further, since the amount of the frost accumulated onto the second evaporator 45 is minimized as described in the foregoing, the quantity of heat for use in defrosting is lessened and, as a result, the time required for defrosting can be made relatively short. Since the quantity of heat for defrosting is sufficiently provided by the condenser 42, the problem of lack of heat does not arise. Therefore, it is not necessary to use an electric heater as used in a conventional defrosting system, which signifies that the temperature in the inside of the cabinet does not abnormally rise and thus the commodities stocked therein are not subject to damage. Furthermore, since the amount of the frost accumulated is so small, the conditions are not caused where the water which is produced by a defrosting action is heated and vaporized and the resultant water vapor is mixed with a circulating cooling air thereby to make an air curtain 15 (FIG. 1) cloudy and in addition water condenses on the body case.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An improved refrigeration apparatus comprising first and second cooling means for cooling air disposed in a cooling air passage having an air drawing slit, a cooling air current flowing through said cooling air passage in a direction from said slit, said second cooling means being located in said cooling air current upstream of said first cooling means, wherein the improvement comprises:

said first cooling means comprises first closed refrigerant circuit means including first compressor means having a suction side and a discharge side, condenser means having an outlet and an inlet, said condenser means inlet being coupled to said first compressor means discharge side, first pressure reducing means having an outlet and an inlet, said reducing means inlet being coupled to said condenser means outlet, and first evaporator means having an inlet and an outlet, said evaporator means inlet being coupled to said pressure reducing means outlet and said first evaporator means outlet being coupled to said first compressor means suction side;

said second cooling means comprises second closed refrigerant circuit means including said condenser in common with said first refrigerant circuit coupled in parallel therewith, said second closed refrigerant circuit means including second compressor means having a suction side and a discharge side, said condensor means inlet being coupled to said second compressor means discharge side, second pressure reducing means having an outlet and an inlet, said reducing means inlet being coupled to said condensor means outlet, and second evaporator means having an inlet and an outlet, said second evaporator means inlet being coupled to said second pressure reducing means outlet and said second evaporator means outlet being coupled to said second compressor means suction side;

wherein the evaporating temperature of refrigerant in said second evaporator means is higher than that in said first evaporator means; and control means for controlling said second compressor means including timer means for setting first and second predetermined time periods and providing a timing output signal in accordance therewith said second compressor means responsive to said timing output signal being intermittently and periodically driven during said first predetermined time period and not driven during said second predetermined time period, thereby stopping cooling by said second cooling means during the non-driven period of said second compressor means.

2. A refrigerating apparatus in accordance with any one of claim 1 which further comprises second driving control means for controlling said first compressor means according to refrigeration load of said refrigerating apparatus.

3. A refrigerating apparatus in accordance with claim 1, wherein said refrigerating apparatus can be driven both in a refrigeration mode and a defrosting mode, and which further comprises passage establishing means for establishing a passage in which a gaseous refrigerant can flow from at least one discharging side of said first compressor means and said second compressor means through said first evaporator means and said condenser means in said defrosting mode, whereby said condenser means operates as an evaporator to defrost said first evaporator means in said defrosting mode.

4. A refrigerating apparatus in accordance with claim 3, wherein the discharging side of said second compressor means is directly connected to the inlet of said condenser means, and said second compressor means is adapted to stop in said defrosting mode.

5. A refrigerating apparatus in accordance with claim 3, wherein said passage establishing means comprises connection switching means for switching connection of said lines so that in response to said refrigeration mode the inlet of said condenser means is connected to the discharging sides of said first compressor means and said second compressor means and the outlet of said first evaporator means is connected to the suction side of said first compressor means, while in response to said defrosting mode at least one discharging side of said first compressor means and said second compressor means is connected to the outlet of said first evaporator means.

6. A refrigerating apparatus in accordance with claim 5, wherein said connection switching means comprises a four way selection valve having four ports which are capable of being connected/disconnected to each other in the inside thereof, the first port of said four way selection valve being connected to the inlet of said condenser means, the second port being connected to the discharging side of said first compressor means and said second compressor means, the third port being connected to the suction side of said first compressor means, and the fourth port being connected to the outlet of said first evaporator means, said four way selection valve is adapted such that the intraconnection thereof is changed over either in said refrigeration mode or in said defrosting mode.

7. A refrigerating apparatus in accordance with claim 6, wherein one of said first compressor means and said second compressor means is adapted to stop in said defrosting mode.

8. A refrigerating apparatus in accordance with claim 6, wherein said passage establishing means comprises connecting means for connecting said outlet of said second evaporator means to said suction side of said first compressor means in said defrosting mode, both said first compressor means and said second compressor means are driven in said defrosting mode.

9. A refrigerating apparatus in accordance with claim 8, wherein said connecting means comprises valve means interposed between the outlet of said second evaporator means and the suction side of said first compressor means and being opened in said defrosting mode.

10. A refrigerating apparatus in accordance with claim 3, wherein said first pressure reducing means comprises a first expansion valve, and a first electromagnetic valve connected between said first expansion valve and the outlet of said condenser means and being opened in said refrigeration mode.

11. A refrigerating apparatus in accordance with claim e, wherein said first pressure reducing means comprises a directional expansion valve permitting the flow of refrigerant only in said refrigeration mode.

12. A refrigerating apparatus in accordance with claim 11, wherein said directional expansion valve comprises a thermo responsive automatic expansion valve wherein an opening of a forward direction is controlled in correlation to a load of said first evaporator means, while the opening of the opposite direction is almost small.

13. A refrigerating apparatus in accordance with claim 3, wherein said second pressure reducing means comprises a second expansion valve, and a second electromagnetic valve connected between said second expansion valve and the outlet of said condenser means and being opened in said refrigeration mode.

14. A refrigerating apparatus in accordance with claim 3, wherein said passage establishing means comprises a third pressure reducing means connected to said first pressure reducing means in a parallel manner wherein in said defrosting mode the refrigerant flows in a direction opposite to that in said refrigeration mode.

15. A refrigerating apparatus in accordance with claim 14, wherein said third pressure reducing means comprises a third expansion valve, and a check valve connected between said third expansion valve and the outlet of said condenser means and permitting the flow of the refrigerant in said defrosting mode.

16. A refrigerating apparatus in accordance with claim 15, which further comprises a third electromagnetic valve connected to said check valve in a parallel manner and being opened in said refrigeration mode.

* * * * *

UNITED STATES PATENT AND TRADEMARK OFFICE

CERTIFICATE OF CORRECTION

PATENT NO. : 4,474,026

DATED : October 2, 1984

INVENTOR(S) : Mochizuki, et al.

It is certified that error appears in the above-identified patent and that said Letters Patent are hereby corrected as shown below:

Title page, Item [73] should read as follows:

-- Assignees: Hitachi Ltd., Tokyo, Japan
Shin Meiwa Industry Co., Ltd., Hyogo-Ken, Japan
--.

Signed and Sealed this

*Thirtieth* Day of *April 1985*

[SEAL]

*Attest:*

DONALD J. QUIGG

*Attesting Officer* *Acting Commissioner of Patents and Trademarks*